US007792449B2

(12) United States Patent
Kurokawa

(10) Patent No.: US 7,792,449 B2
(45) Date of Patent: Sep. 7, 2010

(54) IMAGE FORMING APPARATUS HAVING IMPROVED PROTECTION AGAINST OVER-HEATING

(75) Inventor: Koji Kurokawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 613 days.

(21) Appl. No.: 11/680,123

(22) Filed: Feb. 28, 2007

(65) Prior Publication Data

US 2007/0217806 A1 Sep. 20, 2007

(30) Foreign Application Priority Data

Mar. 15, 2006 (JP) ..... 2006-071323

(51) Int. Cl.
*G03G 15/20* (2006.01)

(52) U.S. Cl. ..... 399/69; 399/33

(58) Field of Classification Search ..... 399/69, 399/67, 320, 33
See application file for complete search history.

(56) References Cited

U.S. PATENT DOCUMENTS 5,512,993 A 4/1996 Endo et al.
RE36,124 E * 3/1999 Yokoyama et al. ..... 399/69
6,006,051 A * 12/1999 Tomita et al. ..... 399/69
7,340,192 B2 * 3/2008 Kinouchi et al. ..... 399/69
7,471,911 B2 * 12/2008 Ide et al. ..... 399/69
7,526,216 B2 * 4/2009 Shimokawa ..... 399/69
2002/0044789 A1 * 4/2002 Nanataki et al. ..... 399/69
2003/0059235 A1 3/2003 Senda
2004/0052542 A1 3/2004 Kinoshita
2004/0190924 A1 * 9/2004 Iwasaki et al. ..... 399/69
2005/0211700 A1 * 9/2005 Kondo et al.

FOREIGN PATENT DOCUMENTS

JP 61091679 A 5/1986
JP 05-080605 4/1993
JP 2004302152 A * 10/2004

* cited by examiner

*Primary Examiner*—Susan S Lee
(74) *Attorney, Agent, or Firm*—Rabin & Berdo, P.C.

(57) ABSTRACT

In an image forming apparatus which uses a pressing roller and a fixing roller that are pressing and contacting each other to sandwich record medium and fixes toner image onto the record medium, in order to inhibit a temperature in non-paper passing area from extremely rising, a temperature detecting section detects a temperature of the fixing roller via a thermistor (2) 75 installed in the non-paper passing area of the record medium in the fixing roller; a temperature comparing section 44 compares the detection temperature detected by the temperature detecting section 62 with a predetermined standard temperature, a print controlling section 45 reduces heat amount provided to the fixing roller for a predetermined period when the detection temperature exceeds the standard temperature on the basis of a comparison result of the temperature comparing section 44.

14 Claims, 10 Drawing Sheets

IMAGE FORMING APPARATUS HAVING IMPROVED PROTECTION AGAINST OVER-HEATING

BACKGROUND OF THE INVENTION

1. Field of the Invention

The invention relates to an image forming apparatus such as printer, facsimile apparatus, copying apparatus or the like, which has a heat-fixing device.

2. Related Background Art

In an image forming apparatus such as printer, facsimile apparatus, copying apparatus and the like, a fixing device of heat-roller type which has a fixing roller and a pressing roller is popularized. In the fixing device of heat-roller type, because using long roller, on the roller, there are a paper passing area that is passed by record medium; and a non-paper passing area that does not directly contact with record medium. On the one hand, in the paper passing area, through a heat absorption effect produced by a passage of the record medium, an unreasonable rise of temperature difficultly occurs. On the other hand, in the non-paper passing area, because a heat absorption effect produced by record medium is small, a temperature rise is easy to become unreasonable. Thereby, because of the difference of the both temperatures rises, roller may be damaged.

Then, in the conventional way, in order to prevent the temperature rise in the non-paper passing area from becoming unreasonable, not only a temperature detecting member is provided to the paper passing area, but also an other temperature detecting member is provided to the non-paper passing area, when a temperature rise in the non-paper passing area is detected to be unreasonable, it is executed to turn off the electricity of the fixing roller; and to reopen the operation after the temperature sufficiently dropped. Such technology may refer to patent document 1.

Patent document 1: Japan patent publication H05-80605.

However, in the above stated conventional temperature control, when a temperature rise in the non-paper passing area is detected to be unreasonable, because it is necessary to turn off the electricity of the fixing roller and to wait for the temperature to sufficiently drop, the print operation must be stopped for a long time. Therefore, such problem to be solved is left.

SUMMARY OF THE INVENTION

It is, therefore, an object of the invention to provide an image forming apparatus capable of solving the above problem.

According to the present invention, there is provided an image forming apparatus, comprising a fixing member which is heated by a predetermined heat source and fixes developer onto predetermined record medium;

a pressing member which is installed to face to the fixing member and presses and contacts with the fixing member;

a temperature detecting element which detects a temperature of a non-paper passing area in a length direction of the fixing member;

a temperature comparing section which compares a detection temperature value detected by the temperature detecting element with a predetermined standard temperature value; and a print controlling section which reduces heat amount provided to the fixing member from the heat source for a predetermined period when the detection temperature value is judged exceeding the standard temperature value by the temperature comparing section.

Moreover, in the image forming, if the detection temperature value is judged once again exceeding the standard temperature value by the temperature comparing section when the predetermined period ends, the print controlling section may execute fixations with respect to record mediums of predetermined sheet number previously set to correspond to the standard temperature value.

Moreover, in the image forming apparatus, the standard temperature value may be set at plural stages, the higher the standard temperature value is, the fewer the predetermined sheet number is set.

Moreover, in the image forming apparatus, a cleaning process of the temperature detecting element may be performed in the predetermined period.

Moreover, in the image forming apparatus, the cleaning process may include a step to stop supplying electricity to the heat source.

Further, according to the present invention, there is also provided an image forming apparatus, comprising:

a fixing member which is heated by a predetermined heat source and fixes developer onto predetermined record medium at a first set temperature and a first conveyance speed;

a pressing member which is installed to face to the fixing member and presses and contacts with the fixing member;

a temperature detecting element which detects a temperature of a non-paper passing area in a length direction of the fixing member;

a temperature comparing section which compares a detection temperature value detected by the temperature detecting element with a predetermined standard temperature value; and a print controlling section which, when the detection temperature value is judged exceeding the standard temperature value by the temperature comparing section, executes fixation operation by switching the first set temperature to a lower second set temperature and switching the first conveyance speed to a slower second conveyance speed.

THE EFFECT OF THE PRESENT INVENTION

According to the present invention, such effect can be obtained, that is: when the temperature in the non-paper passing area of the fixing member exceeds a predetermined standard temperature, the supply of a heat source toward the fixing member is stopped for a predetermined period so that a drop of the temperature can be attained; further, through inserting a cleaning sequence in the predetermined period, the effect can be more improved; furthermore, through executing the cleaning sequence at the time that the fixing member reaches the standard temperature and switching to an intermittent print, the temperature in the non-paper passing area of the fixing member is difficult to rise to an upper limit temperature, and it is possible to inhibit the fixing member and the pressing member from changing for the worse and from being damaged.

The above and other objects and features of the present invention will become apparent from the following detailed description and the appended claims with reference to the accompanying drawings.

DETAILED DESCRIPTION OF THE PREFERRED EMBODIMENTS

Embodiments of the invention will be described in detail hereinbelow with reference to the drawings.

Embodiment 1

Figure 1:
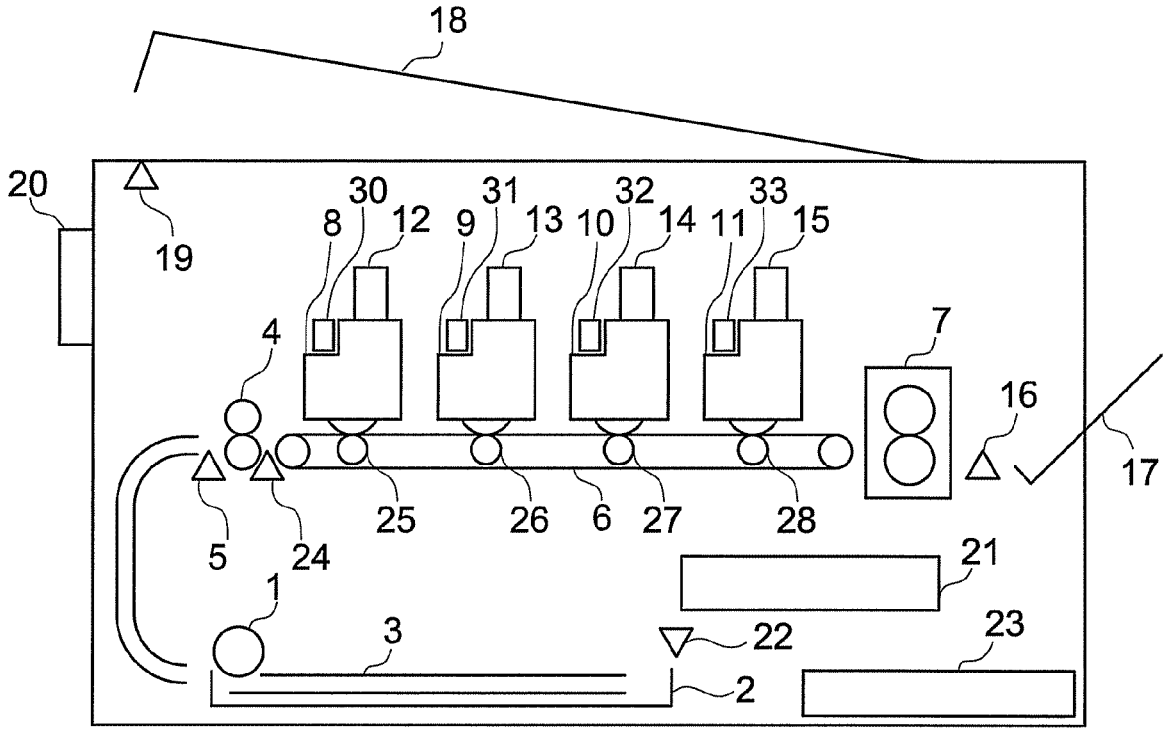
FIG. 1 is an explanation diagram showing a structure of an image forming apparatus of the present invention.

FIG. 1 is an explanation diagram showing a structure of an image forming apparatus of the present invention.

As shown by the FIG. 1, a record medium 3 set in a paper supplying tray 2 is conveyed to a paper supplying roller 4 by a rotation of a hopping roller 1. The record medium 3 is further conveyed to a fixing device 7 by a belt 6 via drum units 8, 9, 10 and 11 serving as image forming sections. At that time, after the record medium 3 is detected by a writing sensor 24, respective formations of toner images onto the drum units 8, 9, 10 and 11 are started through LED heads 30, 31, 32 and 33. The formed toner images are transferred onto the record medium 3 by transferring rollers 25, 26, 27 and 28.

Then, the record medium 3 on which the toner images are formed is conveyed the fixing device 7 by the belt 6. The fixing device 7 heats and presses the record medium 3, then fixes the toner images onto the surface of the record medium 3. Further, the record medium 3 on whose surface the toner images are fixed is conveyed to a stacker 17. A paper supplying sensor 5 and an ejecting sensor 16 monitors a passage of the record medium 3, and when they did not detect the passage of the record medium 3 at respective predetermined timings, they notify a mechanism controlling section 21 that an abnormality happens (for example, a medium jam). When the mechanism controlling section 21 received the notification, it immediately makes print operation stop, and displays detection contents on an operation panel 20 in order to request operator to solve the abnormality.

In order to solve the abnormality, the operator opens an apparatus cover 18, and removes the record medium 3 which is jamming in the inside, then closes the apparatus cover 18 after the record medium 3 is removed. An apparatus cover optical sensor 19 detects whether the apparatus cover 18 is opening or is closing, and notifies the mechanism controlling section 21 of a detection result. Further, in the case to exchange toner cartridge 12, 13, 14 or 15 respectively installed in the drum units 8, 9, 10 and 11 when toner in the toner cartridges 12, 13, 14 or 15 becomes short; or in the case to exchange the drum unit 8, 9, 10 or 11, or to exchange the fixing device 7 when utility time limit is over, the operator also opens and closes the apparatus cover 18. In the case that the operator supplements the record medium 3, he/she first draws the paper supplying tray 2, after supplemented the record medium 3, inserts the paper supplying tray 2 once again. A paper supplying tray drawing and inserting optical sensor 22 detects whether the paper supplying tray 2 is drew or is inserted, and notifies the mechanism controlling section 21 of a detection result.

The following is to explain in detail a temperature control system of fixing device 7 in which the present invention is directly applied.

Figure 2:
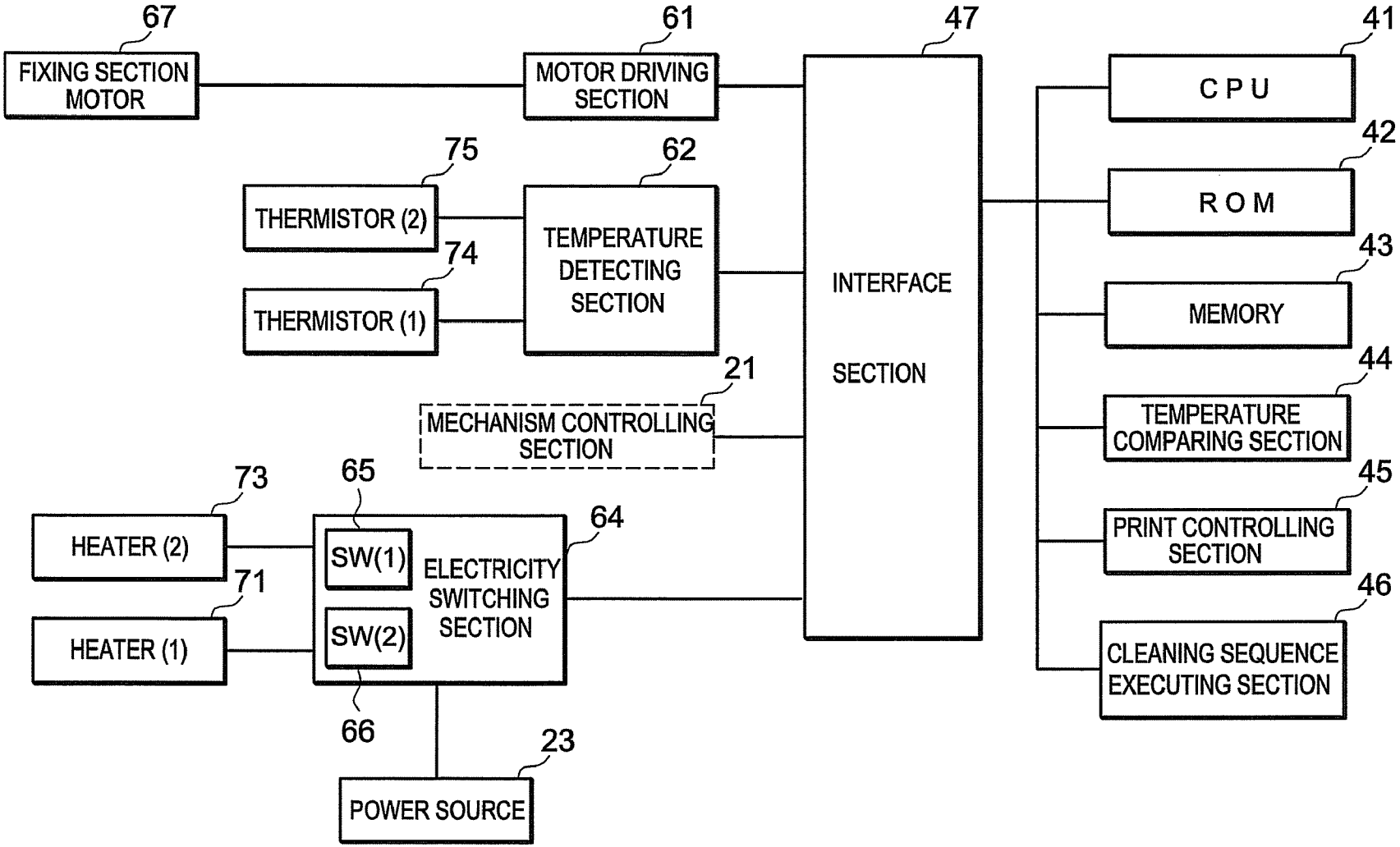
FIG. 2 is a block diagram showing a fixation temperature control system of embodiment 1.

FIG. 2 is a block diagram showing a fixation temperature control system of embodiment 1.

As shown by the FIG. 2, a fixation temperature control system of the embodiment 1 comprises a power source 23; a CPU 41; a ROM 42; a memory 43; a temperature comparing section 44; a print controlling section 45; a cleaning sequence executing section 46; an interface section 47; a motor driving section 61; a temperature detecting section 62; an electricity switching section 64; a SW (1) 65; a SW (2) 66; a fixing section motor 67; a heater (1) 71; a heater (2) 73; a thermistor (1) 74; and a thermistor (2) 75.

The power source 23 is a part to supply power to the heater (1) 71 and the heater (2) 73 via the electricity switching section 64 so as to make them become heat sources. The CPU 41 is a micro processor to perform a control of the fixation temperature control system by performing control program previously stored in the ROM 42, in the embodiment, specially, it is also a part to start up and generate the temperature comparing section 44, the print controlling section 45 and the cleaning sequence executing section 46 as function blocks shown by the FIG. 2 through performing predetermined control program previously stored in the ROM 42. The ROM 42 is a read-only memory to previously store control program for performing control of the fixation temperature control system through an execution of the CPU 41.

The memory 43 is a non-volatile memory to previously store necessary control data such as temperature table, predetermined print fixation sheet number and the like, in order to perform the predetermined control program previously stored in the ROM 42. The temperature comparing section 44 is a part to compare a detection temperature detected by the temperature detecting section 62 via the thermistor (1) 74 and the thermistor (2) 75 with a set temperature or a standard temperature previously stored in the memory 43, and to judge their levels.

The print controlling section 45 is a part to make electricity toward the heater (1) 71 and the heater (2) 73 turn off for a predetermined period via the electricity switching section 64, when the detection temperature exceeds the standard temperature on the basis of a comparison result of the temperature comparing section 44. Further, the print controlling section 45 also is a part to control the fixing section motor 67 via the motor driving section 61 and to execute a print fixation process of predetermined sheet number previously stored in the memory 43, when the electricity toward the heater (1) 71 and the heater (2) 73 turns on.

The cleaning sequence executing section 46 is a part to execute a cleaning process in order to remove foreign substance such as toner, paper powder or the like adhering to the thermistor (1) 74 and the thermistor (2) 75 used in the fixing device 7 and to keep the temperature detection in an appropriate state, via the mechanism controlling section 21 (FIG. 1), during the print controlling section 45 makes electricity toward the heater (1) 71 and the heater (2) 73 turn off for a predetermined period via the electricity switching section 64. The interface section 47 is an interface circuit for connecting the CPU 41 with the motor driving section 61, the temperature detecting section 62, the electricity switching section 64 and the mechanism controlling section 21. The motor driving section 61 is a driving circuit to drive the fixing section motor 67 on the basis of a control of the print controlling section 45.

The temperature detecting section 62 is a part to detect a temperature in the inside of the fixing device 7 (FIG. 1) via the thermistor (1) 74 and the thermistor (2) 75, and to send the temperature to the temperature comparing section 44. The electricity switching section 64 is a part which, in its inside, has the SW (switch) (1) 65 and the SW (switch) (2) 66, and switches on or off the heater (1) 71 and the heater (2) 73 on the basis of the control of the print controlling section 45. The fixing section motor 67 is a motor to drive the fixing device 7 via the motor driving section 61 on the basis of the control of the print controlling section 45. The heater (1) 71 and the heater (2) 73 are heaters to heat a pressing roller and a fixing roller in the inside of the fixing device 7, they are manufactured by Halogen lamp in general. The thermistor (1) 74 and the thermistor (2) 75 are sensor to measure temperatures of the fixing roller provided in the inside of the fixing device 7 (FIG. 1).

The following is to explain a summary of inside structure of the fixing device 7 (FIG. 1).

Figure 3:
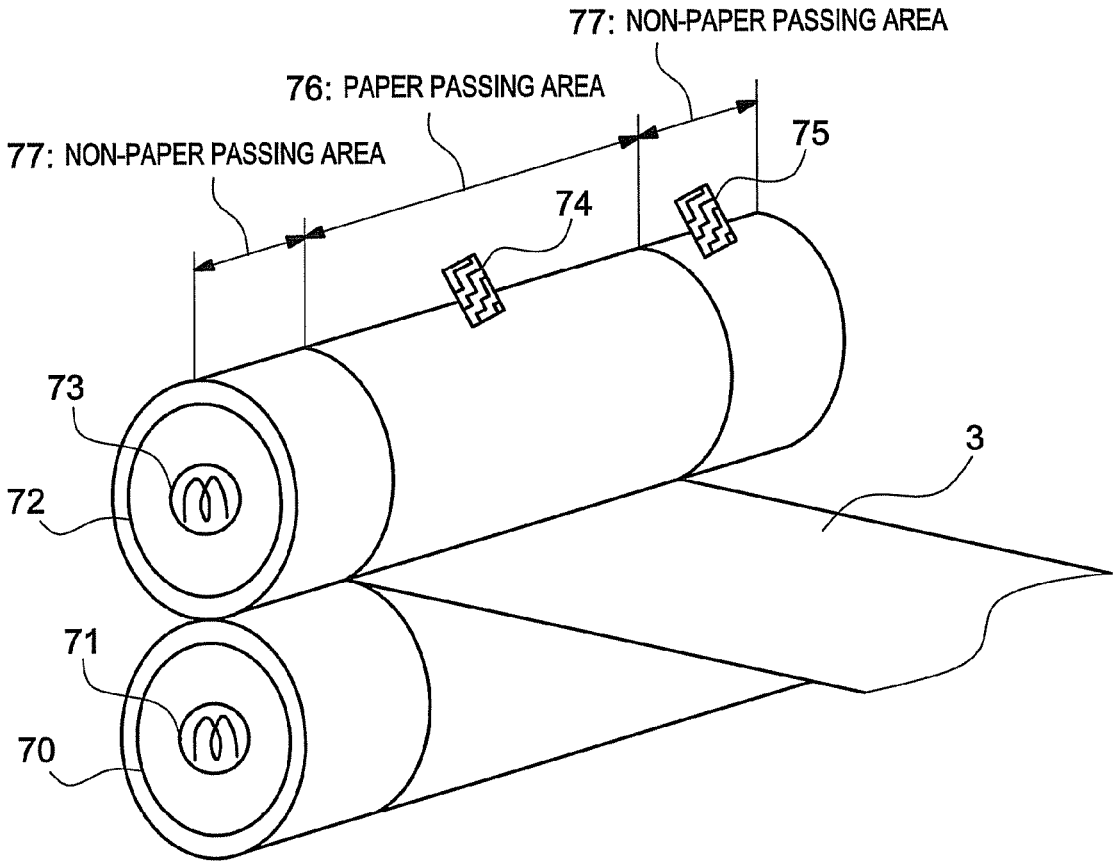
FIG. 3 is an explanation diagram showing a main structure part of a fixing device provided in an image forming apparatus in embodiment 1.

FIG. 3 is an explanation diagram showing a main structure part of a fixing device provided in an image forming apparatus in embodiment 1.

As shown by the FIG. 3, the image forming apparatus of the embodiment 1 comprises the fixing device 7 of heat-pressure manner, which uses a pressing roller 70 and a fixing roller 72 that press each other while rotating, to sandwich the record medium 3; and makes toner image on the record medium 3 fix. On the two rollers, a paper passing area 76 that is a part that the record medium 3 passes through and a non-paper passing area 77 that is a part that the record medium 3 does not contact are formed. Further, in the inside of the pressing roller 70, the heater (1) 71 is provided; and in the inside of the fixing roller 72, the heater (2) 73 is provided. Furthermore, on the paper passing area 76 of the fixing roller 72, the thermistor (1) 74 is furnished; and on the non-paper passing area 77 of the fixing roller 72, the thermistor (2) 75 is furnished.

The following is to explain operations of the image forming apparatus of the present invention.

The image forming apparatus is connected with a host apparatus such as PC and the like via cable or wireless (not shown). When received an print command from the host apparatus, the image forming apparatus makes the hopping roller 1 rotate and sends a sheet of record medium 3 to the paper supplying roller 4 from the paper supplying tray 2. The halfway paper supplying sensor 5 detects whether the hopping roller 1 normally performed a paper supply. The drum units 8, 9, 10 and 11 serving as image forming sections and the belt 6 start a rotation of roller kind almost at the same time as the start time of paper supply. At that time, on a charging roller which is installed in the drum unit and is not shown by drawing, a voltage of about −1000V is provided, so that the surface of photosensitive body drum contacting with the charging roller in the drum unit is charged. Toner used for print is provided to the drum unit from the corresponding toner cartridge (12, 13, 14 or 15). The provided toner is frictionally charged in the inside of the drum unit. Further, with the rotation start of the photosensitive body drum, the belt 6 starts to rotate and move in a same speed. The record medium 3 is more conveyed by the paper supplying roller 4, then the writing sensor 24 turns on.

After the front edge of the record medium 3 is detected and a predetermined time passed, the LED heads 30, 31, 32 and 33 start to expose so as to form electrostatic latent images onto the photosensitive body drums respectively installed in the drum units 8, 9, 10 and 11. According to the formed electrostatic latent image, a toner image is formed on the photosensitive body drum. At that time that the record medium 3 arrives at the area between the electrostatic latent image and the belt 6, the transferring rollers 25, 26, 27 and 28 are provided with a voltage of +2000V, toner is attracted to the side of the record medium 3, and a transfer toward the record medium 3 of the toner image is performed. From the upstream to the downstream along a movement direction of the record medium 3, the same exposure and the same transfer are performed one after another. After these transfers toward the record medium 3 ended, the record medium 3 is heated and pressed in between the fixing roller 72 and the pressing roller 70, then toners are fixed on the record medium 3. During the operations including fixing operation are performed, the temperature detecting section 62 continues a watch so that the temperature of the fixing roller 72 does not rise or drop immoderately. After fixation, the front edge of the record medium 3 makes the ejecting sensor 16 which is used for jam watch from the fixing device 7 onward and for medium length detection after fixation turn on. Then, the record medium 3 is ejected to the stacker 17. At that time, in the non-paper passing area 77 which is the outside of maximum paper broad of the fixing roller 72, when the fixing roller 72 continues print, because heat is not absorbed, so that the temperature of the fixing roller 72 rises and a damage due to heat may happen. In order to prevent it from happening, though it is necessary to reduce heat amount provided to the fixing roller 72, if stopping the print operation until that the fixing roller 72 sufficiently becomes cooling as the conventional art, the thruput of print will extremely go down. In view of that, in the embodiment, even if the temperature of the non-paper passing area 77 of the fixing roller 72 rises, in order to prevent the apparatus from stopping for a long time for a cooling process, on the way of print, in the process to reduce the heat amount provided to the fixing roller 72 for a predetermined time, a control of a cleaning sequence is inserted to execute an intermittent print.

The following is to explain a temperature control in the embodiment by using a time chart. In order to make the difference point between the conventional temperature control and the temperature control of the present invention clear, first a comparison example for the conventional temperature control is explained, after that, the temperature control of the present invention will be explained.

Figure 4:
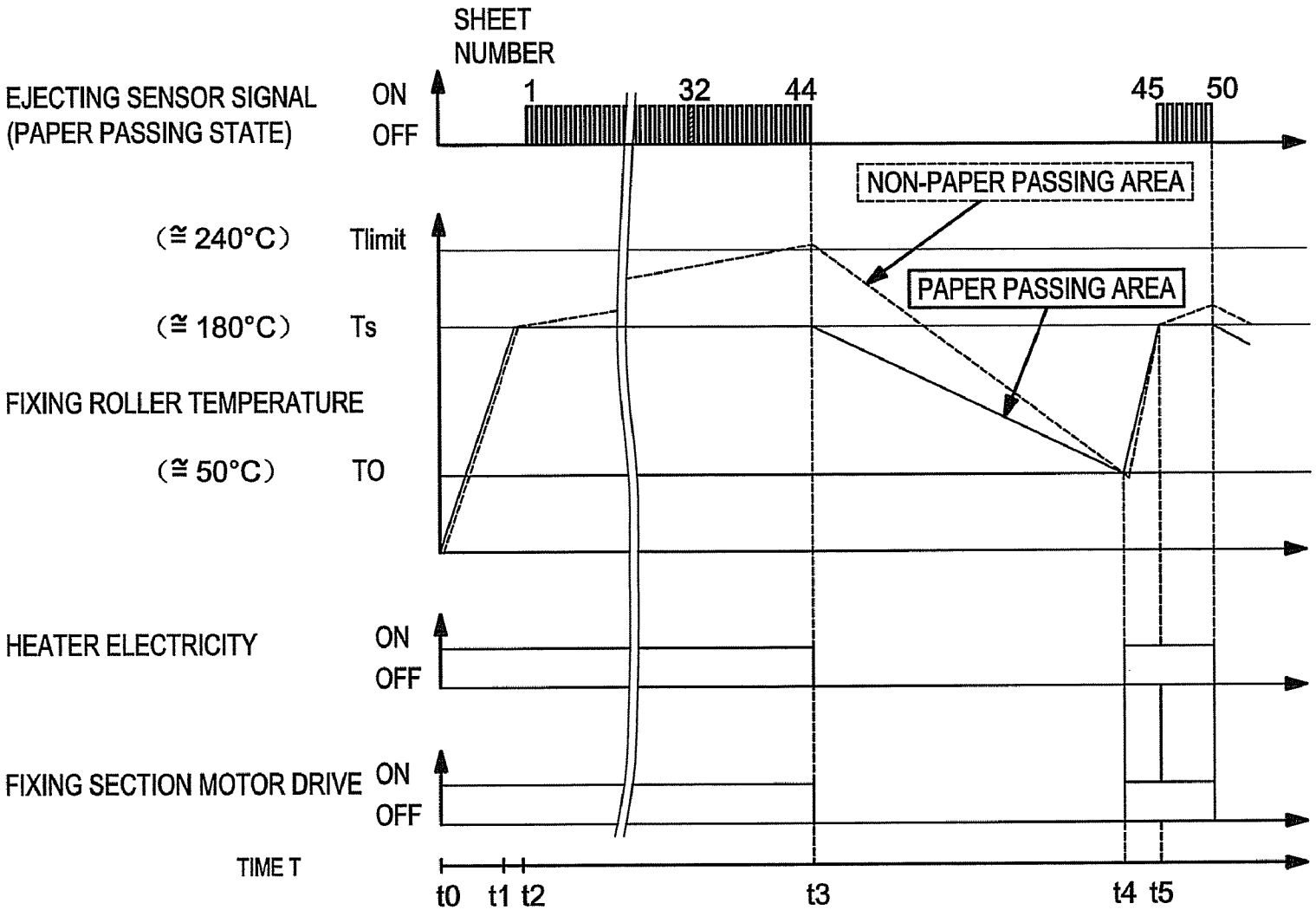
FIG. 4 is a time chart of temperature control in comparison example.

FIG. 4 is a time chart of temperature control in comparison example.

In the FIG. 4, from top to bottom, an ejecting sensor signal indicating a paper passing state; a fixing roller temperature; a heater electricity state; and a fixing section motor drive state are orderly shown. At the lowest bottom of the FIG. 4, a time t used in common for respective items is shown.

The FIG. 4 is an example to show such a case to execute a print process of a print job formed from 50 of papers (50 sheets). At time t0, the heater electricity is turned on. When the fixing roller temperature arrives at a set temperature Ts (for example, 180° C.) at time t1, a print is started. A little later, an ejection of the record medium 3 is started at time t2. For example, if setting that the thermistor (2) 75 (FIG. 3) detected that the temperature of the non-paper passing area 77 (FIG. 3) of the fixing roller 72 (FIG. 3) has exceeded an upper limit temperature Tlimit (e.g. 240° C.) during printing the forty-fourth page (i.e. the 44 paper) (in the meantime, the temperature of the paper passing area 76 (FIG. 3) is kept at Ts), in the case, after the print process and the supply of the record medium behind the forty-fourth page are stopped and after the forty-fourth page is ejected (time t3), the conveyance of the record medium 3 is stopped, the fixing section motor drive and the heater electricity are turned off, then the temperature of the fixing roller 72 (FIG. 3) drops to a sufficient low temperature T0 (e.g. 50° C.), the OFF state continues until time t4.

In the case, the difference between the Tlimit and the T0 is about 190° C., according to the temperature difference, until the time t4 to wait that the temperature of the non-paper passing area 77 (FIG. 3) of the fixing roller 72 (FIG. 3) drops, a long time is needed. In the concrete, when a temperature drop rate of the fixing roller 72 (FIG. 3) is 20° C./minute, about ten minutes are needful. Further, after arrived at the temperature T0, it also has to continue the OFF state until the heater electricity is turned on once more and the fixing roller 72 (FIG. 3) arrives at the temperature Ts at time t5. The difference between the T0 and the Ts is, for example, about 130° C., therefore a rather long time is needed. Thus, in the comparison example, the waiting time from stopping print operation to restarting print operation is long. As a result, operator will worry about whether troubles happened.

Figure 5:
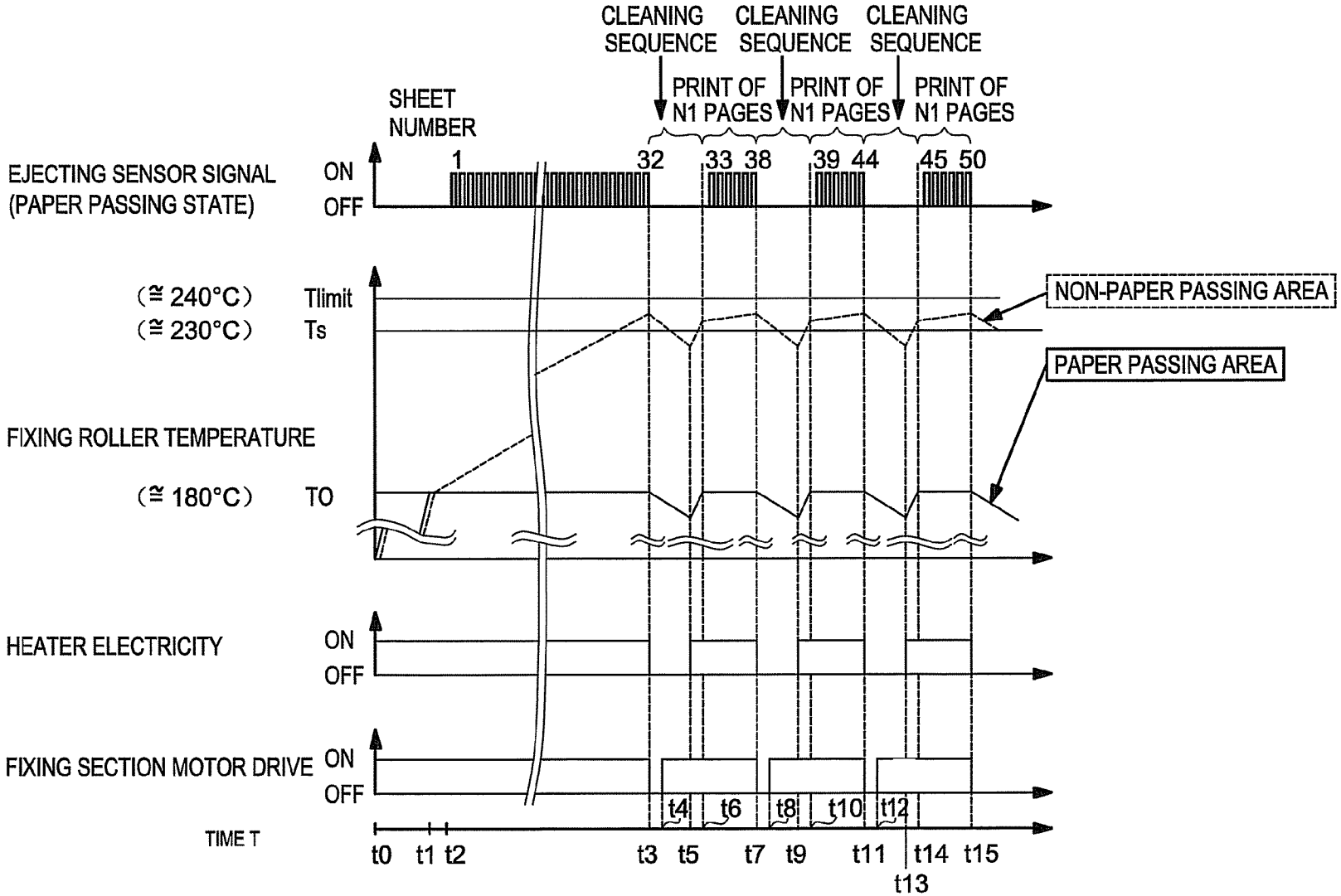
FIG. 5 is a time chart of temperature control in embodiment 1.

FIG. 5 is a time chart of temperature control in embodiment 1.

In the FIG. 5, from top to bottom, an ejecting sensor signal indicating a paper passing state; a fixing roller temperature; a heater electricity state; and a fixing section motor drive state are orderly shown. At the lowest bottom of the FIG. 5, a time t used in common for respective items is shown.

The FIG. 5 is an example to show such a case to execute a print process of a print job formed from 50 of papers (50 sheets) on the basis of a temperature control of the embodiment. At time t0, the heater electricity is turned on. When the fixing roller temperature arrives at a set temperature Ts (for example, 180° C.) at time t1, a print is started. A little later, an ejection of the record medium 3 is started at time t2. For example, if setting that the thermistor (2) 75 (FIG. 3) detected that the temperature of the non-paper passing area 77 (FIG. 3) of the fixing roller 72 (FIG. 3) has exceeded a standard temperature T1 (e.g. 230° C.) during printing the thirty-second page (i.e. the 32 paper) (in the meantime, the temperature of the paper passing area 76 (FIG. 3) is kept at Ts), in the case, after the print process and the supply of the record medium 3 behind the thirty-second page are stopped, and after the print process and an ejection of the thirty-second page are executed, the cleaning sequence executing section 46 (FIG. 2) starts to execute a cleaning sequence of a predetermined period (time t3~t6).

Here, the cleaning sequence is a cleaning process in order to remove foreign substance such as toner, paper powder or the like adhering to the thermistor (1) 74 and the thermistor (2) 75 used for detecting temperature of the fixing roller 72 and to keep the temperature detection in an appropriate state, through re-driving the fixing roller 72, after the conveyance operation of the record medium 3 and the drive operation of the fixing roller 72 are once stopped (time t3~4: about one second). In the cleaning sequence, the electricity toward the heater is stopped for a predetermined time (time t3~t5). In the period (time t3~t5), because the fixing roller 72 and the pressing roller 70 rotate without being heated, through a heat radiation of convection, it is possible to effectively drop the temperature of the fixing roller 72. In the latter half (time t5) of the cleaning sequence, in order to prepare a print process after the thirty-second page, the electricity toward the heater is turned on. As shown by the FIG. 5, at the time t6 that the cleaning sequence ends and the temperature of the paper passing area 76 of the fixing roller 72 arrives at the set temperature Ts (here, it is set that at the same time that the cleaning sequence ends, the temperature of the paper passing area 76 of the fixing roller 72 arrives at the set temperature Ts), the detection temperature of the non-paper passing area 77 of the fixing roller 72 is still higher than the standard temperature T1. Then, at the time t6, the print controlling section 45 reads out a set value N1 of print sheet number previously stored in the memory 43 to correspond to the standard temperature T1, and executes a print process of N1 pages (i.e. N1 sheets, as an example, it may be 6 sheets). At the time (time t7) that the print process and the ejection of the N1 pages ended, because the detection temperature of the non-paper passing area 77 of the fixing roller 72 is in a higher state than the standard temperature T1, the cleaning sequence executing section 46 (FIG. 2) starts once more to execute a cleaning sequence for a predetermined period (time t7~t10).

As shown by the FIG. 5, at the time t10 that the cleaning sequence ended and the temperature of the paper passing area 76 of the fixing roller 72 arrived at the set temperature Ts, the detection temperature of the non-paper passing area 77 of the fixing roller 72 is still higher than the standard temperature T1. Then, at the time t10, the print controlling section 45 executes once more a print process of N1 pages. Through repeating such operations, the print of 50 sheets is executed. The process time of the above-stated cleaning sequence is about 5 seconds. The time is so short to compare with the print stop time in the conventional example. In the drawing, though only three times of cleaning sequence are executed, the total time until the 50 sheets of print ended is also shorter than the comparison example. Moreover, in the drawing, though it is not shown such case that the detection temperature of the non-paper passing area 77 of the fixing roller 72 is lower than the standard temperature T1 after executed a cleaning sequence, according to a setting of the print sheet number N1 or a setting of the standard temperature T1, the detection temperature of the non-paper passing area 77 of the fixing roller 72 may be lower than the standard temperature T1 by executing a cleaning sequence. In the case that the detection temperature of the non-paper passing area 77 of the fixing roller 72 is lower than the standard temperature T1, a general continuation print will be switched.

On the basis of the above-stated temperature control, a fixation process in the image forming apparatus of the embodiment 1 is performed as follows.

Figure 6:
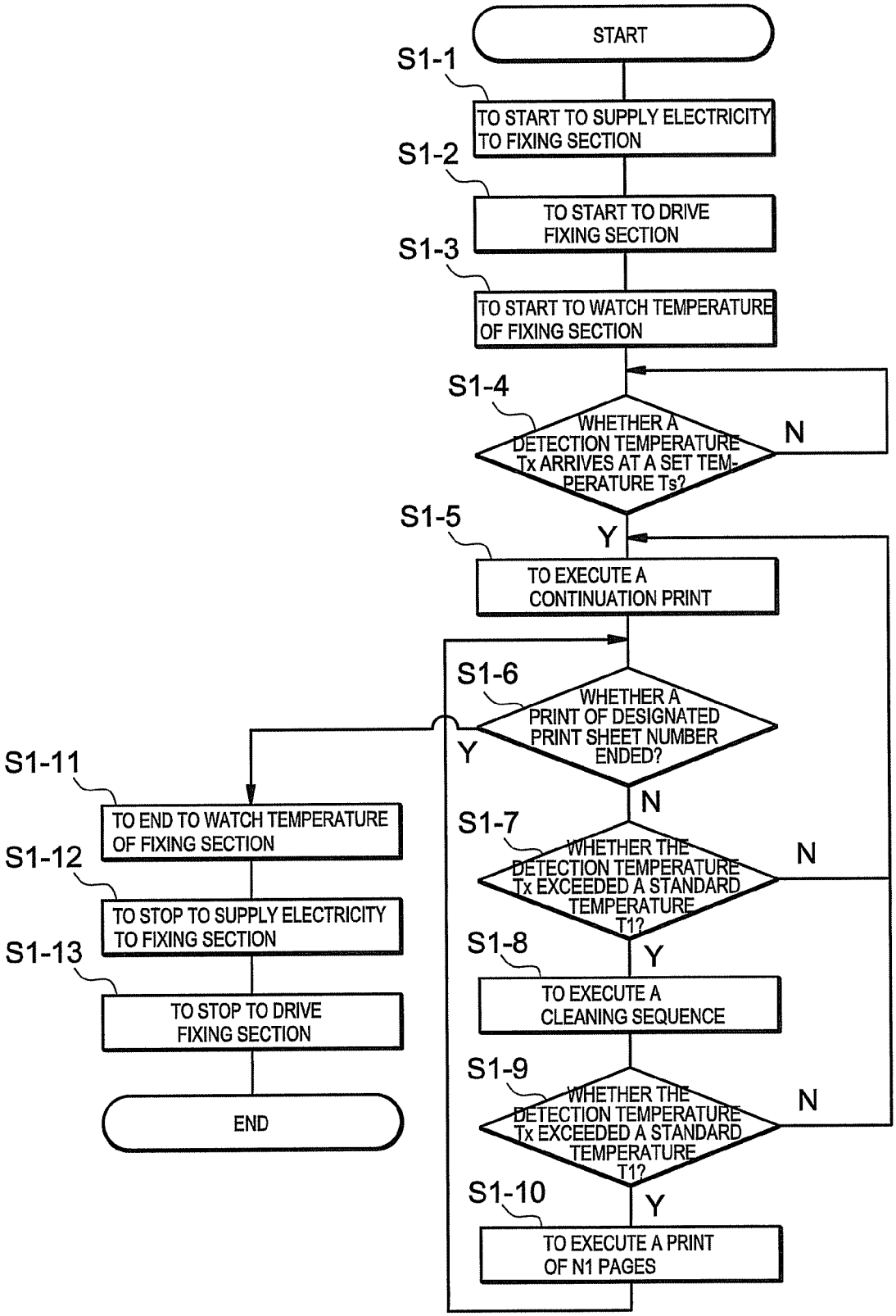
FIG. 6 is a flowchart of fixation process in embodiment 1.

FIG. 6 is a flowchart of fixation process in embodiment 1.

Step S1-1

When received a print instruction from a host apparatus not shown, the print controlling section 45 (FIG. 2) turns on the SW (switch) (1) 65 (FIG. 2) and the SW (switch) (2) 66 (FIG. 2) via the electricity switching section 64 (FIG. 2) in order to heat the fixing roller 72 (FIG. 3) and the pressing roller 70 (FIG. 3).

Step S1-2

At the same time, the print controlling section 45 (FIG. 2) makes the fixing section motor 67 (FIG. 2) start a rotation drive, via the motor driving section 61 (FIG. 2), in order to level the temperature of the fixing roller 72 (FIG. 3).

Step S1-3

The temperature detecting section 62 starts to watch the thermistor (1) 74 (FIG. 2) and the thermistor (2) 75 (FIG. 2) for performing a temperature control of the fixing roller 72 (FIG. 3).

Step S1-4

The temperature comparing section 44 (FIG. 2) judges whether a detection temperature Tx of the fixing roller 72, which is detected via the temperature detecting section 62, arrives at a set temperature Ts. Until the detection temperature Tx arrives at the set temperature Ts, the temperature comparing section 44 repeats the Step S1-4; when the detection temperature Tx arrived at the set temperature Ts, a Step S1-5 is carried out.

Step S1-5

The print controlling section 45 (FIG. 2) starts a continuation print.

Step S1-6

The print controlling section 45 (FIG. 2) judges whether a print of the print sheet number (i.e. page number) designated by the host apparatus ends via the mechanism controlling section 21 (FIG. 1). In the case that the print ended, a Step S1-11 is carried out; and in the case that the print does not end, a Step S1-7 is carried out.

Step S1-7

The temperature comparing section 44 (FIG. 2) judges whether the detection temperature Tx of the non-paper passing area 77 of the fixing roller 72, which is detected via the temperature detecting section 62, exceeds a standard temperature T1. Until the detection temperature Tx exceeds the standard temperature T1, the Steps S1-5~S1-7 are repeated; if the detection temperature Tx exceeded the standard temperature T1 (FIG. 5), a Step S1-8 is carried out.

Step S1-8

When the detection temperature Tx exceeded the standard temperature T1 (FIG. 5), after the print process and the ejection of the record medium 3 which is in an image formation state are performed, the cleaning sequence executing section 46 (FIG. 2) starts to execute a cleaning sequence for a predetermined period.

Step S1-9

When the cleaning sequence ended, the temperature comparing section 44 (FIG. 2) judges once more whether the detection temperature Tx of the non-paper passing area 77 of the fixing roller 72, which is detected via the temperature detecting section 62, exceeds the standard temperature T1. In the case that the detection temperature Tx exceeded the standard temperature T1, a Step S1-10 is carried out; in the case that the detection temperature Tx does not exceed the standard temperature T1, the Step S1-5 is carried out.

Step S1-10

The print controlling section 45 (FIG. 2), after executed an intermittent print in which N1 pages is previously set, returns to the Step S1-6. Moreover, in the case that the remainder print sheet number (page number) is fewer than the N1 pages, only the remainder print sheets (pages) are printed, then to return to the Step S1-6.

Step S1-11

Because the print of the print sheet number (page number) designated by the host apparatus has ended, the temperature detecting section 62 (FIG. 2) ends to watch the thermistor (1) 74 (FIG. 2) and the thermistor (2) 75 (FIG. 2).

Step S1-12

The print controlling section 45 (FIG. 2) stops to supply electricity toward the heater (1) 71 (FIG. 2) and the heater (2) 73 (FIG. 2) via the electricity switching section 64 (FIG. 2).

Step S1-13

The print controlling section 45 (FIG. 2) stops to make the fixing section motor 67 (FIG. 2) rotate via the motor driving section 61 (FIG. 2), and ends the flow.

As explained above, in the embodiment, when the temperature of the non-paper passing area 77 (FIG. 3) of the fixing roller 72 (FIG. 3) exceeded the standard temperature T1 which is previously set, through reducing heat amount provided to the fixing roller 72 (FIG. 3) for a predetermined period, that is, through stopping to supply electricity to the fixing roller 72 (FIG. 3) for a predetermined period, such effect can be obtained: it is possible to drop temperature.

Further, through inserting a cleaning sequence into the predetermined period, it is possible to obtain a better effect. That is, in the cleaning sequence, the heater electricity is turned off, further, the fixing section motor is stopped for a time (about one second), but its drive is re-started immediately. Thereby, the heat radiation of convection is increased by the rotation operations of the pressing roller 70 (FIG. 3) and the fixing roller 72 (FIG. 3), and the temperature drop of the fixing roller 72 becomes rapid. Furthermore, because the process time of the cleaning sequence is about 5 seconds and it is very shorter than the print stop time in the comparison example, so the total print process time is shorter than the comparison example. Further, through executing the cleaning sequence at the time that the fixing member reaches the standard temperature T1 and switching to an intermittent print, the temperature of the fixing roller is difficult to rise to an upper limit temperature Tlimit, and it is possible to inhibit the fixing roller from changing for the worse and from being damaged.

Embodiment 2

In the embodiment 1, because the standard temperature T1 is set at one stage, even if executing a cleaning sequence and an intermittent print according to the setting of the standard temperature T1 or the setting of the print sheet number N1, also there is a fear that the detection temperature of the non-paper passing area 77 of the fixing roller 72 increases slowly to the upper limit temperature Tlimit. In the embodiment, to correspond to such case, a standard temperature is set at plural stages; further, to correspond to the respective standard temperatures, a plurality of print sheet numbers are set and are switched.

Figure 7:
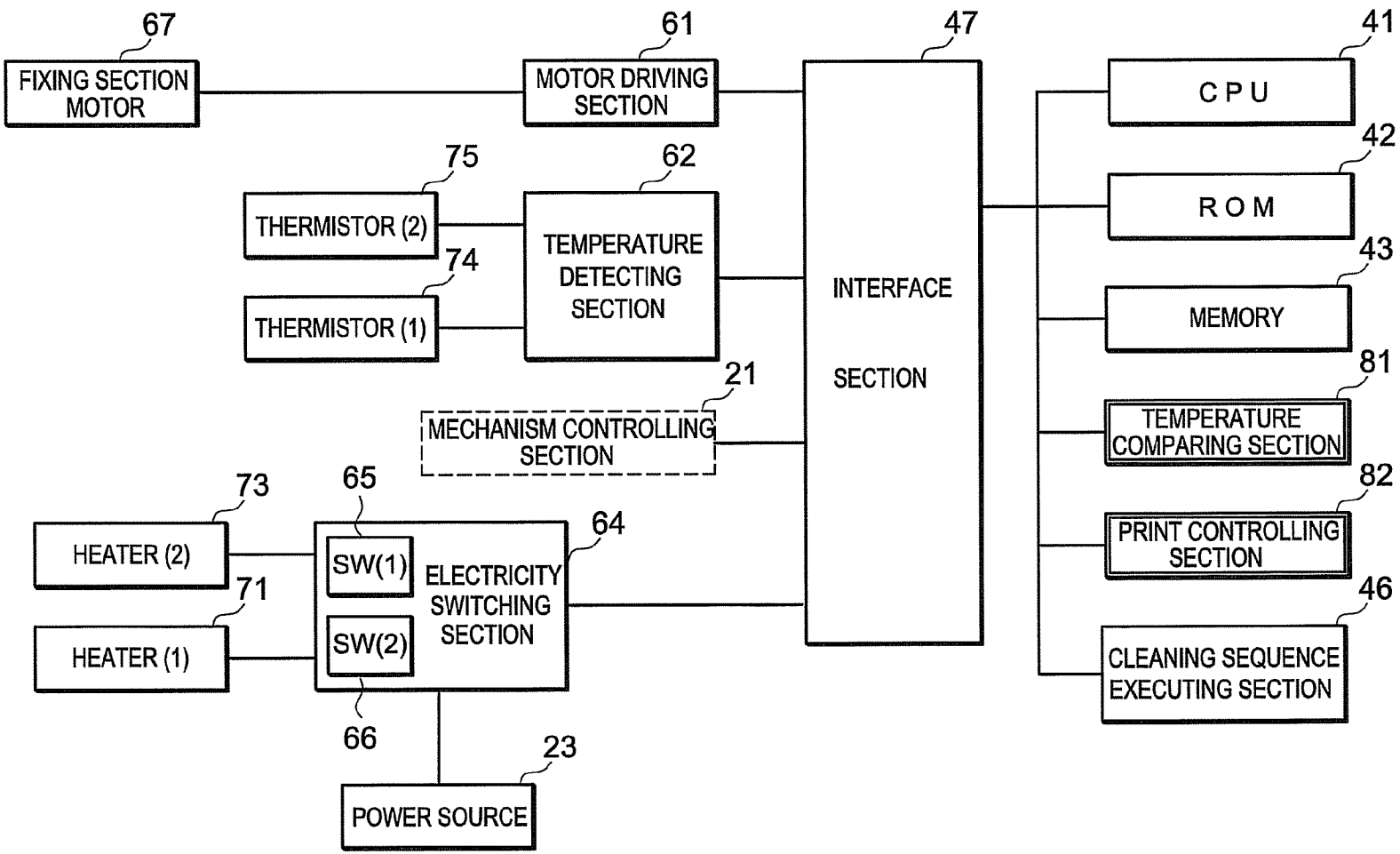
FIG. 7 is a block diagram showing a fixation temperature control system of embodiment 2.

FIG. 7 is a block diagram showing a fixation temperature control system of embodiment 2.

As shown by the FIG. 7, a fixation temperature control system of the embodiment 2 comprises a power source 23; a CPU 41; a ROM 42; a memory 43; a temperature comparing section 81; a print controlling section 82; a cleaning sequence executing section 46; an interface section 47; a motor driving section 61; a temperature detecting section 62; an electricity switching section 64; a SW (1) 65; a SW (2) 66; a fixing section motor 67; a heater (1) 71; a heater (2) 73; a thermistor (1) 74; and a thermistor (2) 75. Next is to explain in detail only regarding the different parts that are different from the embodiment 1. Moreover, regarding the same element as that in the embodiment 1, it will be granted a same sign, and its explanation will be omitted.

The temperature comparing section 81 is a part to compare a detection temperature detected by the temperature detecting section 62 via the thermistor (1) 74 and the thermistor (2) 75 with a first standard temperature and a second standard temperature previously stored in the memory 43, and to judge their levels.

The print controlling section 82 is a part to make electricity toward the heater (1) 71 and the heater (2) 73 turn off for a predetermined period via the electricity switching section 64, when the above-stated detection temperature exceeds the first standard temperature or the second standard temperature on the basis of a comparison result of the temperature comparing section 81. Further, the print controlling section 82 also is a part to execute a print fixation process of predetermined sheet number previously stored in the memory 43, when the electricity toward the heater (1) 71 and the heater (2) 73 turns on after the electricity toward the heater (1) 71 and the heater (2) 73 turned off for the predetermined period.

The following is to explain a temperature control in the embodiment by using a time chart.

Figure 8:
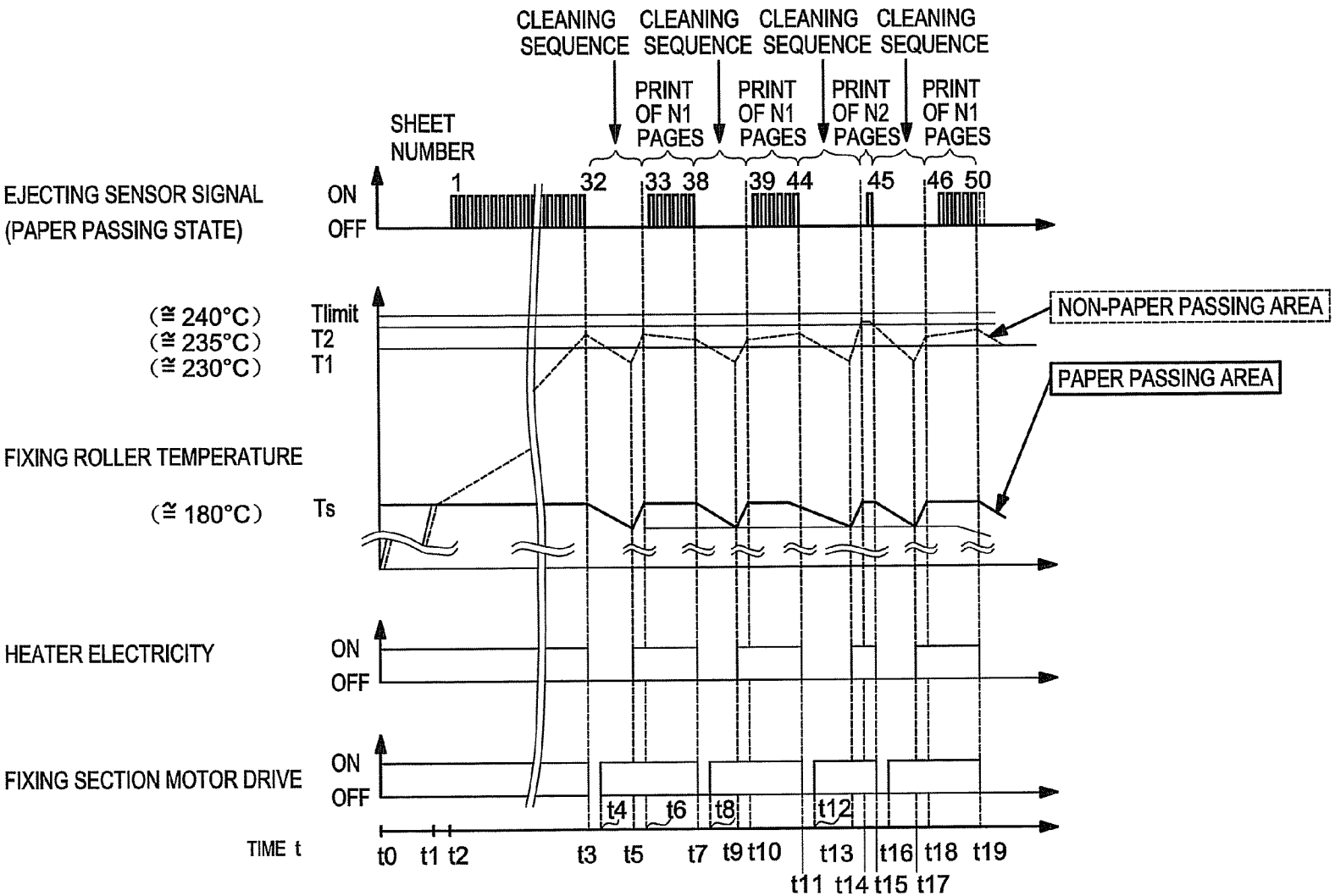
FIG. 8 is a time chart of temperature control in embodiment 2.

FIG. 8 is a time chart of temperature control in embodiment 2

In the FIG. 8, from top to bottom, an ejecting sensor signal indicating a paper passing state; a fixing roller temperature; a heater electricity state; and a fixing section motor drive state are orderly shown. At the lowest bottom of the FIG. 8, a time t used in common for respective items is shown.

The FIG. 8 is an example to show such a case to execute a print process of a print job formed from 50 of papers (50 sheets) on the basis of a temperature control of the embodiment. At time t0, the heater electricity is turned on. When the fixing roller temperature arrives at a set temperature Ts (for example, 180° C.) at time t1, a print is started. A little later, an ejection of the record medium 3 is started at time t2. For example, if setting that the thermistor (2) 75 (FIG. 3) detected that the temperature of the non-paper passing area 77 (FIG. 3) of the fixing roller 72 (FIG. 3) has exceeded a first standard temperature T1 (e.g. 230° C.) during printing the thirty-second page (i.e. the 32 paper) (in the meantime, the temperature of the paper passing area 76 (FIG. 3) is kept at Ts), in the case, after the print process and the supply of the record medium behind the thirty-second page are stopped, and after the print process and the ejection of the thirty-second page are executed, the cleaning sequence executing section 46 (FIG. 7) starts to execute a cleaning sequence of a predetermined period (time t3~t6). In the cleaning sequence, the electricity toward the heater is stopped for a predetermined time (time t3~t5). In the period (time t3~t5), because the fixing roller 72 and the pressing roller 70 rotate without being heated, through a heat radiation of convection, it is possible to effectively drop the temperature of the fixing roller 72.

In the latter half (time t5) of the cleaning sequence, in order to prepare a print process after the thirty-second page, the electricity toward the heater is turned on. As shown by the FIG. 8, at the time t6 that the cleaning sequence ends and the temperature of the paper passing area 76 of the fixing roller 72 arrives at the set temperature Ts (here, it is set that at the same time that the cleaning sequence ends, the temperature of the paper passing area 76 of the fixing roller 72 arrives at the set temperature Ts), the detection temperature of the non-paper passing area 77 of the fixing roller 72 is still higher than the first standard temperature T1. Then, at the time t6, the print controlling section 82 reads out a set value N1 of print sheet number previously stored in the memory 43 to correspond to the first standard temperature T1, and executes a print process of N1 pages (i.e. N1 sheets, as an example, it may be 6 sheets). At the time (time t7) that the print process and the ejection of the N1 pages ended, because the detection temperature of the non-paper passing area 77 of the fixing roller 72 is in a higher state than the first standard temperature T1, the cleaning sequence executing section 46 (FIG. 7) starts once more to execute a cleaning sequence for a predetermined period (time t7~t10). As shown by the FIG. 8, at the time t10 that the cleaning sequence ended and the temperature of the paper passing area 76 of the fixing roller 72 arrived at the set temperature Ts, the detection temperature of the non-paper passing area 77 of the fixing roller 72 is still higher than the first standard temperature T1.

Then, at the time t10, the print controlling section 82 executes once more a print process of N1 pages. At the time (time t11) that the print process and the ejection of the N1 pages ended once more, because the detection temperature of the non-paper passing area 77 of the fixing roller 72 is in a higher state than the first standard temperature T1, the cleaning sequence executing section 46 (FIG. 7) starts once more to execute a cleaning sequence for a predetermined period (time t11~t14). As shown by the FIG. 8, at the time t14 that the cleaning sequence ended and the temperature of the paper passing area 76 of the fixing roller 72 arrived at the set temperature Ts, the detection temperature of the non-paper passing area 77 of the fixing roller 72 is higher than a second standard temperature T2. Then, at the time t14, the print controlling section 82 reads out a set value N2 of print sheet number previously stored in the memory 43 to correspond to the second standard temperature T2, and executes a print process of N2 pages (i.e. N1 sheets, as an example, it may be 1 sheet). At the time (time t15) that the print process and the ejection of the N2 pages ended, because the detection temperature of the non-paper passing area 77 of the fixing roller 72 is in a higher state than the first standard temperature T1, the cleaning sequence executing section 46 (FIG. 7) starts once more to execute a cleaning sequence for a predetermined period (time t15~t18). As shown by the FIG. 8, at the time t18 that the cleaning sequence ended and the temperature of the paper passing area 76 of the fixing roller 72 arrived at the set temperature Ts, the detection temperature of the non-paper passing area 77 of the fixing roller 72 is lower than the second standard temperature T2.

Then, at the time t18, the print controlling section 82 executes once more a print process of N1 pages. Through repeating such operations, the print of 50 sheets is executed. The process time of the above-stated cleaning sequence is about 5 seconds, the time is so short to compare with the print stop time in the conventional example. In the drawing, though four times of cleaning sequence are executed, the total time until the 50 sheets of print ended is also shorter than the comparison example. Moreover, in the drawing, though it is not shown such case that the detection temperature of the non-paper passing area 77 of the fixing roller 72 is lower than the standard temperature T1 after executed a cleaning sequence, according to settings of the first standard temperature T1 and the second standard temperature T2, and settings of the print sheet number N1 and the print sheet number N2, the detection temperature of the non-paper passing area 77 of the fixing roller 72 may be lower than the standard temperature T1 by executing a cleaning sequence. In the case that the detection temperature of the non-paper passing area 77 of the fixing roller 72 is lower than the first standard temperature T1, a general continuation print will be switched.

On the basis of the above-stated temperature control, a fixation process in the image forming apparatus of the embodiment 2 is performed as follows.

Figure 9:
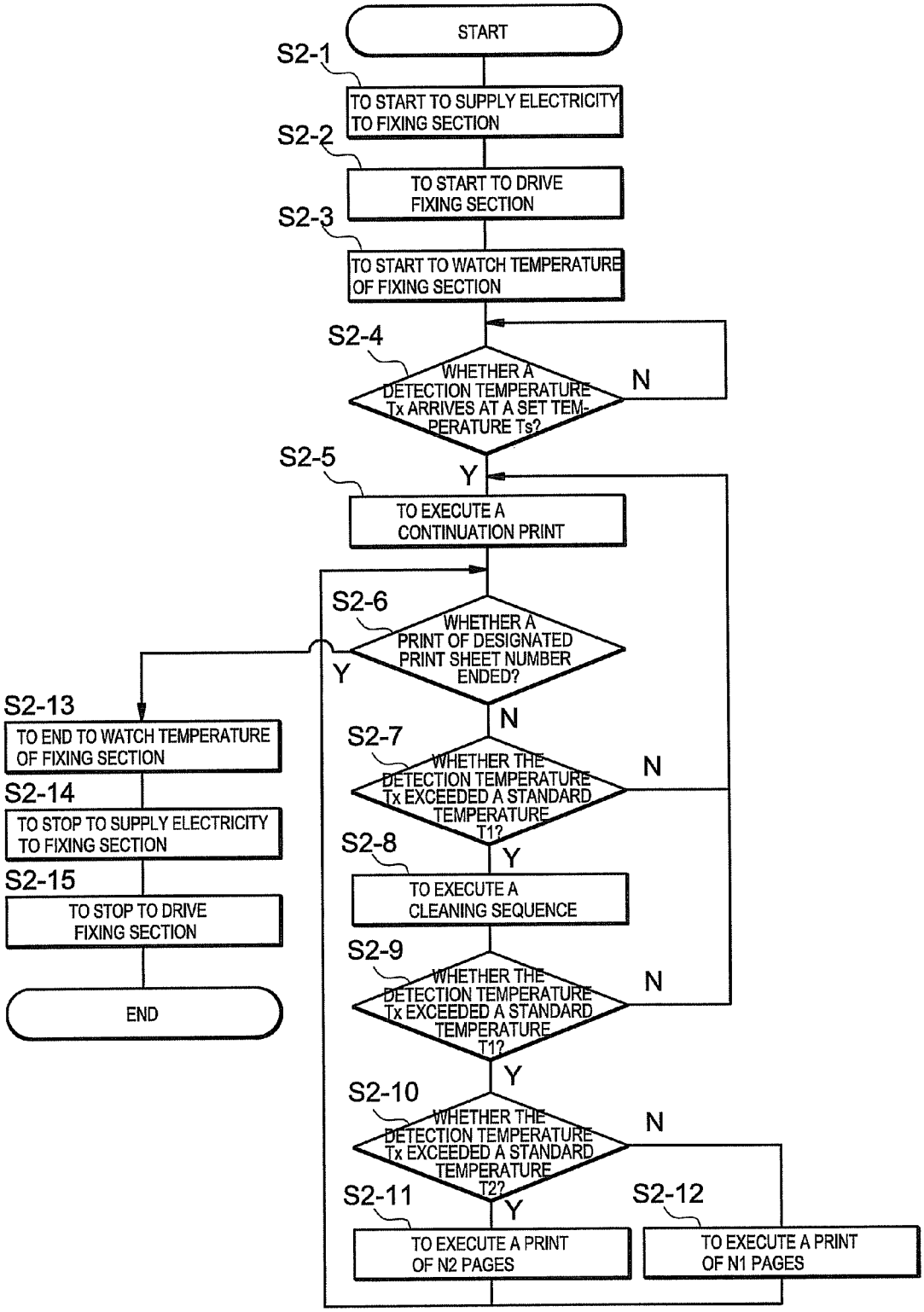
FIG. 9 is a flowchart of fixation process in embodiment 2.

FIG. 9 is a flowchart of fixation process in embodiment 2.

Step S2-1

When received a print instruction from a host apparatus not shown, the print controlling section 82 (FIG. 7) turns on the SW (switch) (1) 65 (FIG. 7) and the SW (switch) (2) 66 (FIG. 7) via the electricity switching section 64 (FIG. 7) in order to heat the fixing roller 72 (FIG. 3) and the pressing roller 70 (FIG. 3).

Step S2-2

At the same time, the print controlling section 82 (FIG. 7) makes the fixing section motor 67 (FIG. 7) start a rotation drive, via the motor driving section 61 (FIG. 7), in order to level the temperature of the fixing roller 72 (FIG. 3).

Step S2-3

The temperature detecting section 62 starts to watch the thermistor (1) 74 (FIG. 7) and the thermistor (2) 75 (FIG. 7) for performing a temperature control of the fixing roller 72 (FIG. 3).

Step S2-4

The temperature comparing section 81 (FIG. 7) judges whether a detection temperature Tx of the fixing roller 72, which is detected via the temperature detecting section 62, arrives at a set temperature Ts. Until the detection temperature Tx arrives at the set temperature Ts, the temperature comparing section 81 repeats the Step S2-4; when the detection temperature Tx arrived at the set temperature Ts, a Step S2-5 is carried out.

Step S2-5

The print controlling section 82 (FIG. 7) starts a continuation print.

Step S2-6

The print controlling section 82 (FIG. 7) judges whether a print of the print sheet number (i.e. page number) designated by the host apparatus ends via the mechanism controlling section 21 (FIG. 1).

In the case that the print ended, a Step S2-13 is carried out; and in the case that the print does not end, a Step S2-7 is carried out.

Step S2-7

The temperature comparing section 81 (FIG. 7) judges whether the detection temperature Tx of the non-paper passing area 77 of the fixing roller 72, which is detected via the temperature detecting section 62, exceeds a first standard temperature T1. Until the detection temperature Tx exceeds the first standard temperature T1, the Steps S2-5~S2-7 are repeated; if the detection temperature Tx exceeded the first standard temperature T1 (FIG. 8), a Step S2-8 is carried out.

Step S2-8

When the detection temperature Tx exceeded the first standard temperature T1 (FIG. 8), after the print process and the ejection of the record medium 3 which is in an image formation state are performed, the cleaning sequence executing section 46 (FIG. 7) starts to execute a cleaning sequence for a predetermined period.

Step S2-9

When the cleaning sequence ended, the temperature comparing section 81 (FIG. 7) judges once more whether the detection temperature Tx of the non-paper passing area 77 of the fixing roller 72, which is detected via the temperature detecting section 62, exceeds the first standard temperature T1. In the case that the detection temperature Tx exceeded the first standard temperature T1, a Step S2-10 is carried out; in the case that the detection temperature Tx does not exceed the first standard temperature T1, the Step S2-5 is carried out.

Step S2-10

The temperature comparing section 81 (FIG. 7) judges whether the detection temperature Tx of the non-paper passing area 77 of the fixing roller 72, which is detected via the temperature detecting section 62, exceeds a second standard temperature T2. If the detection temperature Tx exceeded the second standard temperature T2, a Step S2-11 is carried out; if the detection temperature Tx does not exceed the second standard temperature T2, a Step S2-12 is carried out.

Step S2-11

The print controlling section 82 (FIG. 7), after executed an intermittent print in which N2 pages is previously set, returns to the Step S2-6. Moreover, in the case that the remainder print sheet number (page number) is fewer than the N2 pages, only the remainder print sheets (pages) are printed, then to return to the Step S2-6.

Step S2-12

The print controlling section 82 (FIG. 7), after executed an intermittent print in which N1 pages is previously set, returns to the Step S2-6. Moreover, in the case that the remainder print sheet number (page number) is fewer than the N1 pages, only the remainder print sheets (pages) are printed, then to return to the Step S2-6.

Step S2-13

Because the print of the print sheet number (page number) designated by the host apparatus has ended, the temperature detecting section 62 (FIG. 7) ends to watch the thermistor (1) 74 (FIG. 7) and the thermistor (2) 75 (FIG. 7).

Step S2-14

The print controlling section 82 (FIG. 7) stops to supply electricity toward the heater (1) 71 (FIG. 7) and the heater (2) 73 (FIG. 7) via the electricity switching section 64 (FIG. 7).

Step S2-15

The print controlling section 82 (FIG. 7) stops to make the fixing section motor 67 (FIG. 7) rotate via the motor driving section 61 (FIG. 7) and ends the flow.

As explained above, in the embodiment, because the standard temperature is set at two stages of the first standard temperature T1 and the second standard temperature T2, and the print sheet number N1 and N2 (N1>N2) are switched to correspond to the respective standard temperatures, it is possible to further easily inhibit the temperature from rising and to obtain a better effect than the embodiment 1.

Moreover, in the embodiments 1 and 2, when a temperature of a non-paper passing area exceeded a predetermined standard temperature, a cleaning sequence is inserted so that the heat amount provided to the fixing roller can be reduced. However, it only is an example to reduce the heat amount provided to the fixing roller, the present invention is not limited to the example. That is, when a temperature of a non-paper passing area exceeded a predetermined standard temperature, while dropping the set temperature of the fixing roller, through slowing down the conveyance speed of the record medium to a predetermined speed, it is also possible to reduce the heat amount provided to the fixing roller. The following is a such example.

Figure 10:
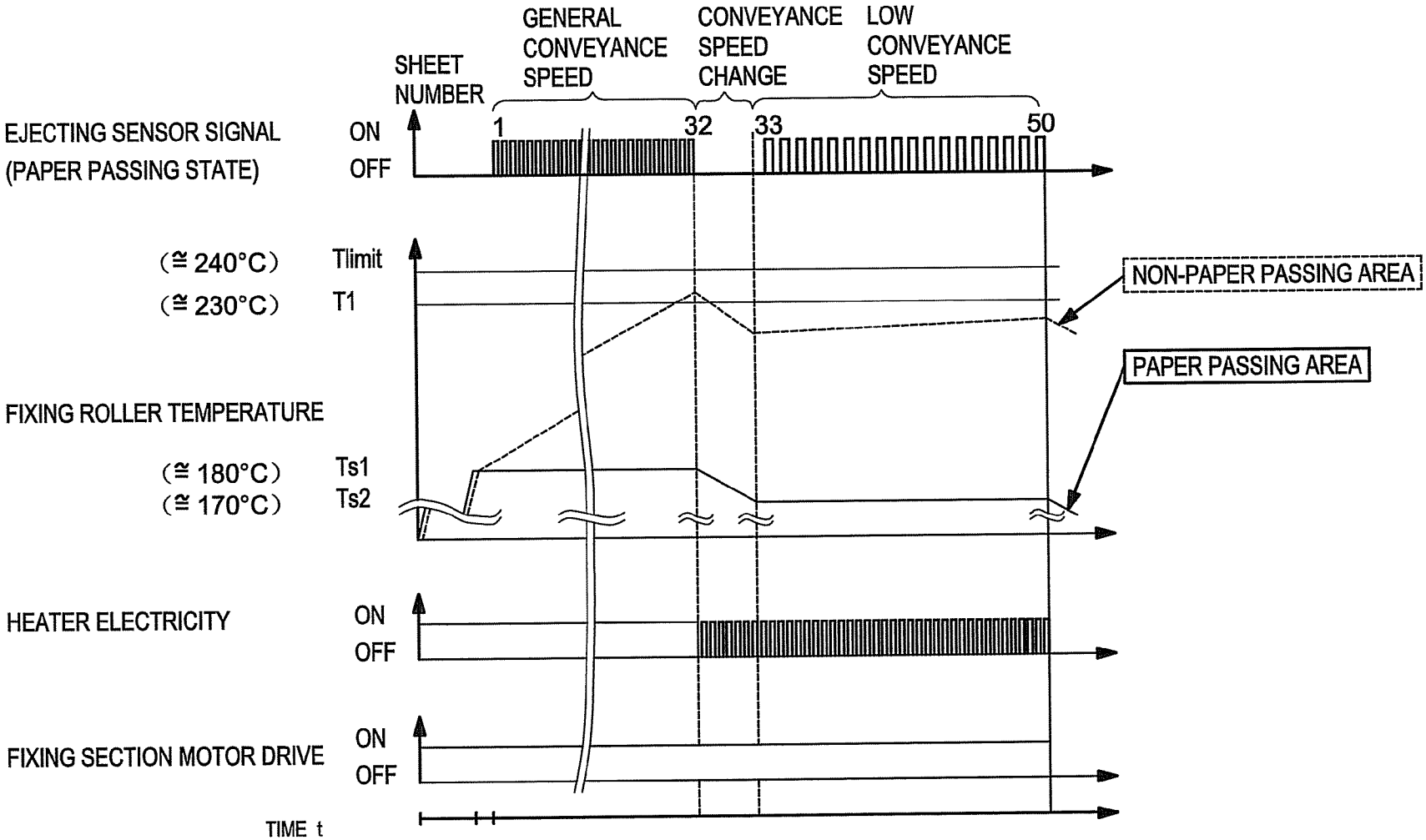
FIG. 10 is a time chart of temperature control in a transformation example.

FIG. 10 is a time chart of temperature control in a transformation example.

In the FIG. 10, from top to bottom, an ejecting sensor signal indicating a paper passing state; a fixing roller temperature; a heater electricity state; and a fixing section motor drive state are orderly shown. At the lowest bottom of the FIG. 10, a time t used in common for respective items is shown.

The FIG. 10 shows such a case to execute a print process of a print job formed from 50 of papers (50 sheets) on the basis of a temperature control of a transformation example of the embodiments 1 and 2. At time t0, the heater electricity is turned on. When the fixing roller temperature arrives at a set temperature Ts1 (for example, 180° C.) at time t1, a print is started. A little later, an ejection of the record medium 3 is started at time t2. For example, if setting that the thermistor (2) 75 (FIG. 3) detected that the temperature of the non-paper passing area 77 (FIG. 3) of the fixing roller 72 (FIG. 3) has exceeded a standard temperature T1 (e.g. 230° C.) during printing the thirty-second page (i.e. the 32 paper) (in the meantime, the temperature of the paper passing area 76 (FIG. 3) is kept at Ts1), in the case, after the print process and the supply of the record medium behind the thirty-second page are stopped, and after an ejection of the thirty-second page is executed (time t3), the print controlling section 45 (or 82) lowers the setting value of conveyance speed of record medium to, for example, 20 ppm from 24 ppm. Further, while lowers the setting value of conveyance speed, the print controlling section 45 (or 82) lowers the set temperature of the fixing roller 72 to Ts2 (e.g. 170° C.) from Ts1. Here, as shown by the FIG. 10, the set temperature of the fixing roller easily changes by turning the electricity toward heater on or off in a predetermined cycle. At the time (time t4) that the conveyance speed of the record medium and the set temperature Ts2 of the fixing roller become stable, a print process after the thirty-second page is executed. Through such method, it is also possible to reduce the heat amount provided to the fixing roller.

The utilization possibility on industry:

As stated above, the case to apply the present invention to a printer is explained, but the present invention is not limited to the case, it also can be applied to other apparatus such as facsimile apparatus, copying apparatus or the like, which has a heat-fixing device.

The present invention is not limited to the foregoing embodiments but many modifications and variations are possible within the spirit and scope of the appended claims of the invention.

What is claimed is:

1. An image forming apparatus, comprising:

a fixing member which is heated by a heat source and fixes developer onto record media;

a pressing member which is installed to face to said fixing member and presses and contacts with said fixing member;

a temperature detecting element which detects a temperature of a non-paper passing area in a length direction of said fixing member;

a temperature comparing section which compares a detection temperature value detected by said temperature detecting element with a predetermined standard temperature value; and a print controlling section which reduces an amount of heat provided to said fixing member from said heat source for a predetermined period when said detection temperature value is judged to exceed said standard temperature value by said temperature comparing section, said temperature detecting element being cleaned in said predetermined period.

2. The image forming apparatus according to claim 1, wherein said print controlling section stops electricity from being supplied to said heat source while said temperature detecting element is being cleaned.

3. An image forming apparatus, comprising:

a fixing member which is heated by a heat source and fixes developer onto record media;

a pressing member which is installed to face to said fixing member and presses and contacts with said fixing member;

a temperature detecting element which detects a temperature of a non-paper passing area in a length direction of said fixing member;

a temperature comparing section which compares a detection temperature value detected by said temperature detecting element with a predetermined standard temperature value; and a print controlling section which reduces an amount of heat provided to said fixing member from said heat source for a predetermined period when said detection temperature value is judged to exceed said standard temperature value by said temperature comparing section, wherein if said detection temperature value is judged once again to exceed said standard temperature value by said temperature comparing section when said redetermined period ends, said print controlling section executes fixation of a predetermined number of sheets of record media previously set to correspond to said standard temperature value, and wherein said print controlling section causes said temperature detecting element to be cleaned in said predetermined period.

4. The image forming apparatus according to claim 3, wherein said print controlling section stops electricity from being supplied to said heat source while said temperature detecting element is being cleaned.

5. An image forming apparatus, comprising:

a fixing member which is heated by a heat source and fixes developer onto record media;

a pressing member which is installed to face to said fixing member and presses and contacts with said fixing member;

a temperature detecting element which detects a temperature of a non-paper passing area in a length direction of said fixing member;

a temperature comparing section which compares a detection temperature value detected by said temperature detecting element with a predetermined standard temperature value; and a print controlling section which reduces an amount of heat provided to said fixing member from said heat source for a predetermined period when said detection temperature value is judged to exceed said standard temperature value by said temperature comparing section, wherein if said detection temperature value is judged once again to exceed said standard temperature value by said temperature comparing section when said predetermined period ends, said print controlling section executes fixation of a predetermined number of sheets of record media previously set to correspond to said standard temperature value, and wherein said standard temperature value is set at plural stages, and the higher said standard temperature value is, the lower said predetermined number of sheets of record media is set.

6. The image forming apparatus according to claim 5, wherein said print controlling section causes said temperature detecting element to be cleaned in said predetermined period.

7. The image forming apparatus according to claim 6, wherein said print controlling section stops electricity from being supplied to said heat source while said temperature detecting element is being cleaned.

8. An image forming apparatus, comprising:

a fixing member which is heated by a heat source and fixes developer onto record media at a first set temperature and a first conveyance speed;

a pressing member which is installed to face to said fixing member and presses and contacts with said fixing member;

a temperature detecting element which detects a temperature of a non-paper passing area in a length direction of said fixing member;

a temperature comparing section which compares a detection temperature value detected by said temperature detecting element with a predetermined standard temperature value; and a print controlling section which, when said detection temperature value is judged to exceed said standard temperature value by said temperature comparing section, executes fixation operation by switching said first set temperature to a second set temperature lower than said first set temperature and switching said first conveyance speed to a second conveyance speed slower than said first conveyance speed.

9. An image forming apparatus, comprising:

a record medium supplying section (4) that supplies record media (3);

at least one image forming section (8, 9, 10, 11) to form an image on an image carrying body;

at least one transfer section (25, 26, 27, 28) that transfers the image formed on the image carrying body onto a sheet of the record medium (3) supplied by the record medium supplying section (4);

a driving section (61);

a heat source (71, 73);

a fixing section (7), driven by the driving section (61) and heated by the heat source (71, 73), to fix developer onto the sheet of the record media (3) on which the image is transferred;

a temperature detecting element (75) that detects a temperature of a non-paper passing area (77) of the fixing section (7);

a temperature comparing section (44) that compares a detection temperature value detected by said temperature detecting element with a predetermined temperature value; and an image controlling section (45) that, when the temperature value is greater than a predetermined temperature value, controls the heat source to reduce a heat amount provided to said fixing section (7) for a predetermined period, controls the record medium supplying section (4) to stop supplying record media, controls the image forming section (8, 9, 10, 11) to stop image formation, and controls the driving section (61) to stop for a first portion of the predetermined period and to operate for a second portion of the predetermined period.

10. The image forming apparatus according to claim 9, wherein the first portion is an initial portion of the predetermined period and the second portion is the remainder of the predetermined period following the initial portion, and wherein the duration of said second portion exceeds the duration of said first portion.

11. The image forming apparatus according to claim 10, wherein, after the predetermined period has passed, the image controlling section controls the record medium supplying section (4) to restart the supply of record media and controls the image forming section (8, 9, 10, 11) to restart image formation.

12. The image forming apparatus according to claim 11, wherein the image controlling section (45) controls said supply of record media and said image formation to stop periodically, on completion of printing of a predetermined number of sheets of record media, and wherein said predetermined number is based on said detected temperature value.

13. The image forming apparatus according to claim 12, wherein the predetermined number is set to one of a plurality of predetermined values, said predetermined values corresponding to respective reference temperature values, and wherein a first one of said predetermined values corresponding to a first reference temperature value is higher than a second one of said predetermined values corresponding to a second reference temperature value where said first temperature is lower than said second temperature.

14. The image forming apparatus of claim 9, wherein the heat amount supplied to the fixing section (7) during the predetermined period is reduced by switching off a power source (23) of the heat source (71, 73).

* * * * *